United States Patent [19]

Takahashi

[11] Patent Number: 5,061,962

[45] Date of Patent: Oct. 29, 1991

[54] COPIER WITH A PLURALITY OF REFERENCE POSITIONS

[75] Inventor: Hiroshi Takahashi, Kawasaki, Japan

[73] Assignee: Ricoh Company, Ltd., Tokyo, Japan

[21] Appl. No.: 433,346

[22] Filed: Nov. 8, 1989

[30] Foreign Application Priority Data

Nov. 12, 1988 [JP] Japan ..... 63-286295

[51] Int. Cl.[5] ..... G03G 15/28

[52] U.S. Cl. ..... 355/233; 355/235; 355/238; 355/313

[58] Field of Search ..... 355/232, 233, 235, 238, 355/243, 308, 311, 204, 208, 75; 358/449, 451, 488, 498; 382/62

[56] References Cited

U.S. PATENT DOCUMENTS

| | | | |
|---|---|---|---|
| 4,211,482 | 7/1980 | Arai et al. | 355/235 |
| 4,595,286 | 6/1986 | Yamazaki | 355/77 |
| 4,626,924 | 12/1986 | Watanabe | 358/285 |
| 4,779,141 | 10/1988 | Watanabe | 358/286 |
| 4,791,451 | 12/1988 | Hirose et al. | 355/311 |

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

A copier for electrostatically forming on a photoconductive element a latent image representative of a document which is laid on a glass platen by illuminating the document through a slit, developing the latent image, and then transferring the developed image to a paper sheet. Optics of the copier is movable between the operating and non-operating sides which are respectively defined at the front and rear sides of the copier body, thereby illuminating the document. A paper sheet is fed from a lower part of the copier body, while a copy produced by reproducing the document on the paper sheet is discharged from a position above the glass platen. A reference position on the glass platen where the document is to be laid is defined at the non-operating side when an automatic document feeder is used and at the operating side when it is not used.

11 Claims, 12 Drawing Sheets

COPIER WITH A PLURALITY OF REFERENCE POSITIONS

BACKGROUND OF THE INVENTION

The present invention relates to a copier of the type having optics which scans a document while moving in a longitudinal direction as viewed from the front or operating side of the copier.

Generally, a copier has a paper feed mechanism and a sheet or copy discharge mechanism at laterally opposite sides thereof as viewed from the side where one is expected to operate the copier, i.e. the operating side. For example, a paper cassette is loaded on the right-hand side of the copier while a copy tray is loaded on the left-hand side. After a toner image representative of a document which is laid on a glass platen has been transferred to a paper sheet that is fed from the paper cassette, the paper sheet or copy is driven out of the copier to the copy tray. Although the paper feeding and paper discharging directions may somewhat differ from one copier to another, the paper feed and paper discharge mechanisms are positioned on laterally opposite sides of the copier without exception. Such an arrangement stems from the fact that the relationship between a document and a copy is easy to set up when a reference document position defined on the glass platen and the initial optics position are coincident, in consideration of the relationship between the moving direction of the optics and photoconductive element and the paper feeding direction.

A problem with a copier having the above configuration is that it needs a large area for installation, i.e., the projective area of the copier body as measured in a plane plus the projective areas of the paper cassette and copy tray which protrude from opposite sides of the copier body. Further, an additional space is needed which is wide enough to allow access to paper cassette in the event of replacement. Eventually, the area necessary for the installation of the copier is far larger than the area which the copier body itself assumes, reducing the area available in an office for other various activities or other office automation equipment.

It is perferable, therefore, to reduce the exclusive area for the copier at least by designing it such that noting protrudes from the opposite sides thereof. This requires the paper feed mechanism to be provided on the front of the copier body, i.e., the operating side for the purpose of facilitating manipulations. Then, a paper transport path which extends from the operating side of the copier toward the rear of the copier is indispensable in relation to the paper discharge. When a copier having such a layout is implemented by conventional optics and developing and fixing arrangements, a photoconductive element is necessarily located in the vicinity of the operating side while the optics start scanning a document at the upstream side with respect to an intended direction of rotation of the photoconductive element. Stated another way, in the layout stated above, the optics begins scanning a document at the opposite side to the operating side, i.e., at the rear end of the copier. This in turn requires the reference position on the glass platen to be defined at the side opposite to the operating side. Such a reference position, however, would render the positioning of a document on the glass platen troublesome and inefficient. Especially, when a documnet in the form of a book is used, the positioning and copying work would be more thoublesome and even pressing it down would sometimes be difficult.

SUMMARY OF THE INVENTION

It is therefore an object of the present invention to provide a copier which saves the area or space for installation.

It is another embodiment of the present invention to provide a copier of the type having optics which is movable in the longitudinal direction as viewed from the operating side in order to facilitate the positioning of a document and promote easy copying work.

It is another object of the present invention to provide a generally improved copier.

In accordance with the present invention, a copier for electrostatically forming on a photoconductive element a latent image representative of an image of a document which is laid on a glass platen by illuminating the document through a slit, developing the latent image, and transferring the developed image to a paper sheet of the present invention comprises a copier body having an operating side and non-operating side which are defined at the front side and the rear side of the copier body, respectively, optics for imagewise exposure movable back and forth between the operating and non-operating sides for illuminating the document, and a reference document position setting device for setting a reference position on the glass platen where the document is to be laid.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
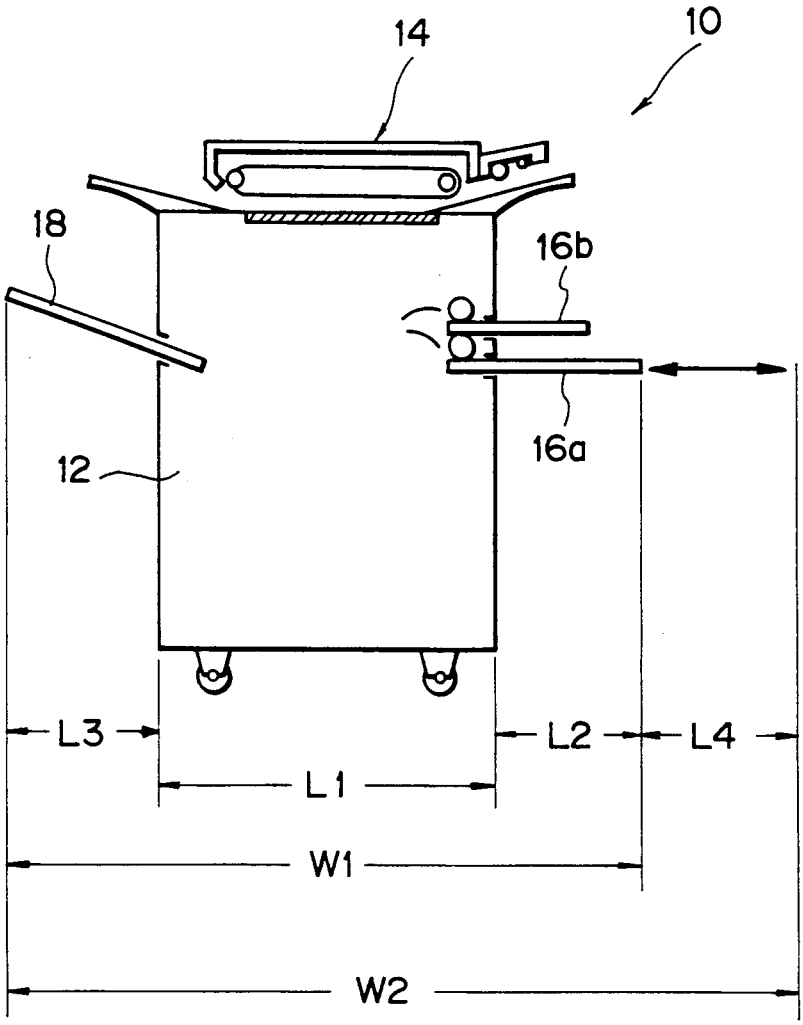
Fig. 1 PRIOR ART
FIG. 1 is a front view of a prior art copier.

To better understand the present invention, a brief reference will be made to a prior art copier, shown in FIG. 1. The copier, generally 10, is shown in a front elevation as viewed from the operating side. The copier 10 is generally made up of a body 12 and an automatic document feeder (ADF) 14 mounted on the top of the body 12. Paper cassettes **16*a* and 16*b* each being loaded with paper sheets of a different size are removably mounted on the right-hand side of the copier body 12, while a copy tray 18 is mounted on the left-hand side. Assume that the copier body 12 has a width L1, that the cassette 16***a* loaded with paper sheets of larger size protrudes to the right of the copier body 12 by a width L2, and that the copy tray 18 projects to the left by a width L3. Then, the copier 10 installed in an office, for example, needs an exclusive space having a width W1 which is at least the sum of the widths L1, L12 and L13. An extra width L4 has to be secured to allow one to mount and dismount the cassette 16*a*. Hence, the copier 10 occupies a total width of W2 which is the sum of the widths L1, L2, L3 and L4, i.e., the widths W1 and L4. The copier 10, therefore, needs a substantial space in an office, compared to other office automation equipment. If the copier 10 is so configured as to save the widths of the cassettes 16*a* and 16*b* and copy tray 18, a space which accommodates only the width L1 of the copier body 12 will suffice, saving much of the space available in an office.

Figure 2:
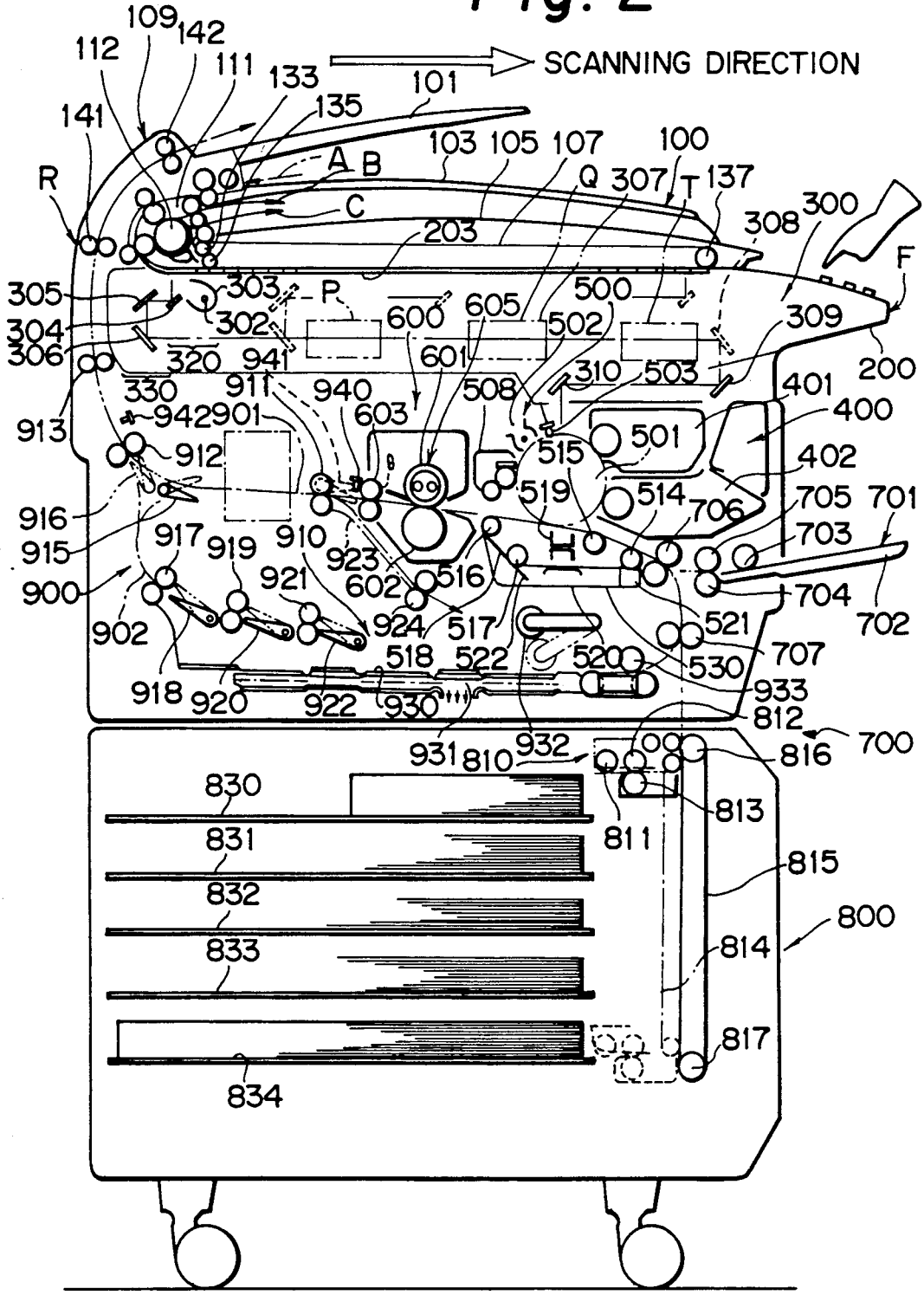
FIG. 2 is a side elevation of a copier embodying the present invention as viewed from the left.

Referring to FIG. 2, a copier embodying the present invention is shown in a side elevation as viewed from the left. In the figure, the right-hand side is the front or operating side F of the copier, and the left-hand side is the rear or non-operating side R. As shown, the copier is made up of an automatic reversal document feeder (ARDF) 100, a copier body 200, and a paper feed device 700.

Figure 3:
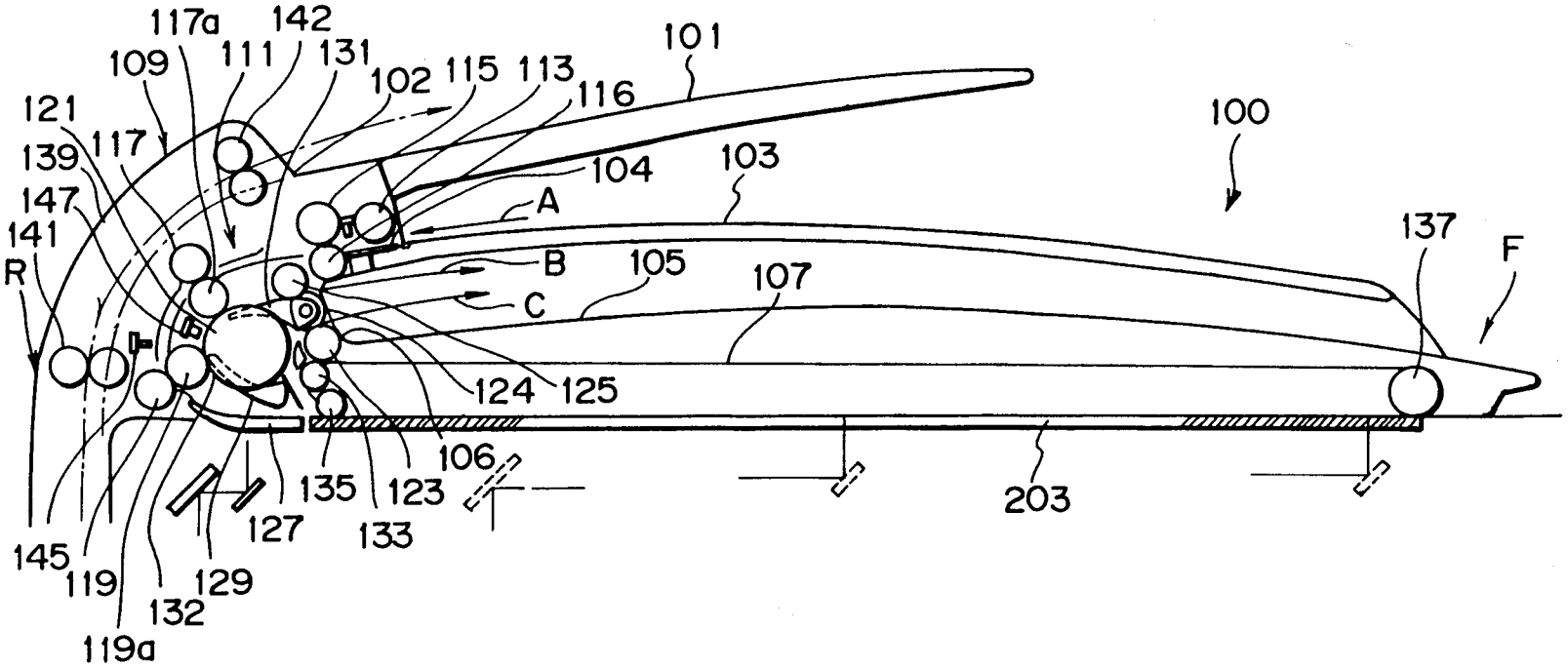
FIG. 3 is a side elevation of an automatic reversal document feeder as viewed from the left.

As shown in FIG. 3, major components of the ARDF 100 are trays 101, 103 and 105 arranged in three consecutive stages, a transport belt 107 incorporated in the lowermost tray 105, and a group of transport rollers 111 accommodated in an ARDF housing 109 on the non-operating side R of the latter. The tray 101 plays the role of a discharge tray for stacking copy sheets thereon and has a paper outlet 102. The tray 103 is a document tray to be loaded with a stack of documents and has a document inlet 104 for sequentially feeding the documents. The tray 105 is a tray on which the documents, whether they be one-sided or two-sided, will be stacked one after another in order of page, and it has a document outlet 106. The copier body 200 has a glass platen 203. The ARDF housing 109 is positioned to face the glass platen 203, and it is rotatably supported at the non-operating side R such that it is movable away from the glass platen 203 at the operating side F. The transport roller group 111 has a pull-out roller 113, a feed roller 115, and a separating roller 116 as named from the roller nearest to the document inlet 104 of the tray 103. Further, roller pairs 117 and 119 and rollers 123, 124 an 125 are arranged around a large diameter roller 121 as named in the counterclockwise direction. Gates 127, 129 and 131 are located one after another along a document transport path 132. The transport roller group 111 is followed by a drive roller 133, a roller 135, and a tension roller 137. The transport belt 107 is passed over the roller 133, 135 and 137. A copy transport path 139 is defined in the deepest position of the ARDF housing 109 as viewed from the operating side F. Two discharge roller pairs 141 and 142 are positioned along the copy transport path 139.

Referring again to FIG. 2, the copier body 200 has therein optics 300 for imagewise exposure, a developing mechanism 400, an image forming mechanism 500, and a transporting mechanism 900. The optics 300 are located below the glass platen 203 to scan a document and are made up of a light source 302, a reflector 303 for reflecting light issuing from the light source 302, movable mirrors 304, 305 and 306, a zoom lens 307, and stationary mirrors 308, 309 and 310. The light source 302, reflector 303 and movable mirror 304 constitute a first scanner 320, while the movable mirrors 305 and 306 constitute a second scanner 330. Assuming that the magnification is m, the first scanner 320 is driven by a motor to move at a rate of V/m to the right as viewed in FIG. 2. At the same time, the second scanner 330 is moved at a rate of V/2 m to the right in FIG. 2. A photoconductive drum 501 is rotated at a constant peripheral speed with no regard to the magnification. A lens drive motor, not shown, drives the zoom lens 307 to shift it on an optical path and thereby changes the magnification. The zoom lens 307 may assume any of the positions P, Q and T which set up the magnifications m of 0.5 (reduction by 50%), 1, and 2.0 (enlargement by 200%), respectively.

Figure 4:
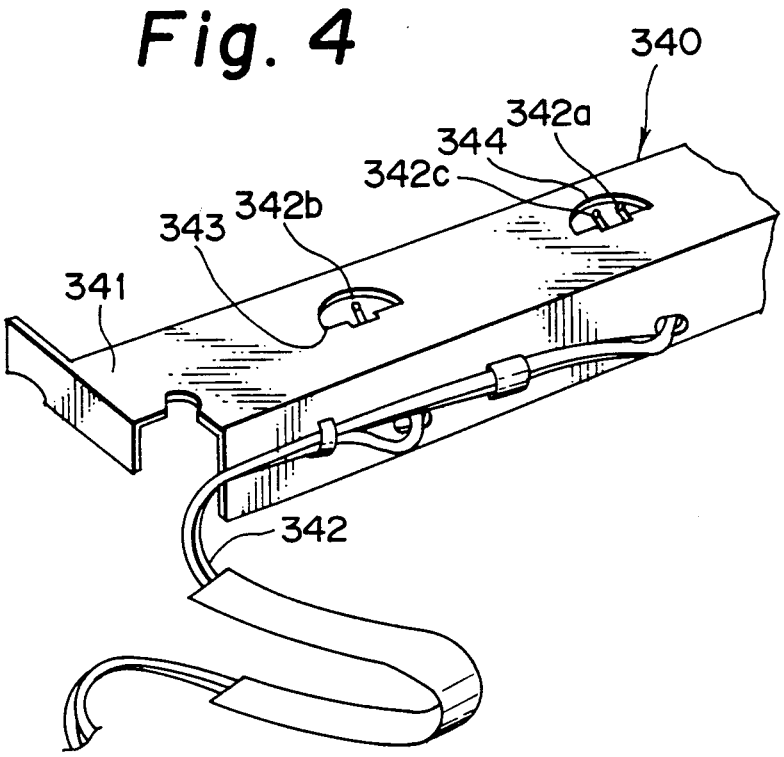
FIG. 4 is a fragmentary perspective view of a document size sensing section.
Figure 5:
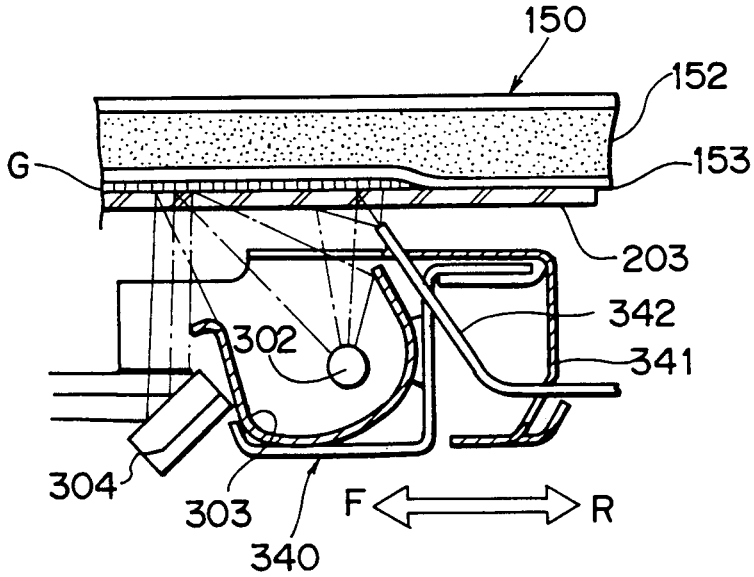
FIG. 5 is a fragmentary section of the document size sensing section.

As shown in FIGS. 4 and 5, a document size sensing section 340 is provided on the first scanner 320 to sense the size of a document. The document size sensing section 340 has a lamp cover 341 to which the reflector 303 and light source 302 are affixed, and three optical fibers 342 protruding from openings 343 and 344 which are formed through the top wall of the lamp cover 341. The optical fibers 342 guide a reflection from a reflective sheet 153, which will be described, to their associated light-sensitive elements, not shown. Specifically, an optical fiber 342*a* protrudes from the opening 344 for sensing the length of a document, an optical fiber 342*b* protrudes from the opening 343 for sensing the width of a document, and an optical fiber 342 protrudes from the opening 344 to sense the density of a document. The ARDF 100 has a cover plate 150 which is made up of the above-mentioned reflective sheet 153 which faces the glass platen 203 for pressing a document G from above, and a sponge-like foam member 152 filled in the reflective sheet 143.

As shown in FIG. 2, the image forming mechanism 500 is mainly constituted by the drum 501 which is located at a right lower position as viewed in the figure. Arranged around the drum 501 are a main charger 502 for uniformly charging the surface of the drum 501, an eraser 503 for erasing the charge in unnecessary potions, a first and a second developing unit 401 and 402 for depositing a toner on an electrostatic latent image by a magnet brush, a belt type image transferring unit 530 for transferring the resulting toner image from the drum 501 to a paper sheet, and a cleaning unit 508 for cleaning the belt 501 to remove toner particles which remain on the latter after the image transfer. The developing units 401 and 402 constitute the previously mentioned developing mechanism 400. The transferring unit 530 has a plurality of rollers 514, 515, 516 and 517, an endless belt 518 passed over the rollers 514 to 517, a transfer charger 519, a discharger 520, a charger 521 for attracting a paper sheet, and a rubber blade 522. To transfer a toner image from the drum 501 to a paper sheet, the belt 518 is lightly urged against the drum 501 while the transfer charger 519 effects corona discharge at the back of the belt 518. Subsequently, the rubber blade 522 removes residue from the belt 518, and then the discharger 520 dissipates the charge on the belt 518. Thereafter, the charger 521 charges the belt 518 to allow the latter to attract a paper sheet which will be fed.

The fixing unit 600 has a heat roller pair 605 made up of a fixing roller and a pressing roller 602, and a discharge roller pair 603. The heat roller pair 605 faces and sandwiches a transport path 901 which extends from the roller 516 that is located at the downstream end of the belt 518 with respect to the intended transport direction. While a paper sheet is moved away from a register roller pair 706 and then retained by the belt 518, the toner image is transferred to the paper sheet. When the paper sheet with the toner image is transported through the heat roller pair 605, the toner image is fixed by heat. The paper sheet, or copy, coming out of the fixing unit 600 is routed to the copy tray 101 or a paper re-feed device 901, which will be described, via the discharge roller pair 603.

The paper sheet re-feed device 901 is included in the paper transport mechanism 900 for implementing a multiple copy mode and a two-sided copy mode, in addition to the transport path which extends from the paper feed mechanism 700 to the copy tray 101. In the re-feed mechanism 910, transport roller pairs 911, 912 and 913 are arranged along the transport path 901 defined downstream of the discharge roller pair 603. A belt having apertures 930 is disposed below the transport path 901 as viewed in FIG. 2 so as to stack and feed copies. Gates 915 and 916 are disposed above the belt 930 in order to steer a copy. A roller pair 917, a gate 918, a roller pair 919, a gate 920, a roller pair 921 and a gate 922 are arranged in this order along a transport path 902 which extends from the gates 915 and 916 to the belt 930. A guide 923 and a roller pair 924 are disposed between the roller pair 911 and the belt 930. The belt 930 is rotated through a chamber 931 which is communicated to a suction fan. A regulating roller 932 is located above the belt 930. Further, a separating roller 933 is positioned at the downstream end of the belt 930 with respect to the rotating direction of the belt 930, so that copies may be handed over again to the transport roller pair 707 one by one.

The paper feed mechanism 700 is generally made up of a manual multi-feed device 701 associated with the copier body 200, and a multi-stage paper feed device 800 having a plurality of trays. The manual multi-feed device 701 has a paper guide 702, a pull-out roller 703, a feed roller 704, and a separating roller 705. To use the manual paper feed device 701, a paper guide 702 which is usually closed is opened as shown in FIG. 2, and then a stack of paper sheets are loaded thereon. Then, the paper sheets are drawn into the copier body 200 by the pull-out roller 703 and then fed one one by one by the feed roller 704 and separating roller 705. The paper sheet guided by the paper guide 702 is temporarily stopped by the register roller pair 706 and, timed to the leading edge of a toner image formed on the drum 501, further driven by the registerr roller pair 706. The multi-stage paper feed device 800 is mainly constituted by trays 830, 831, 832, 833 and 834 which are arranged in five consecutive stages. A paper feed unit 810 has a pull-out roller 811, a feed roller 812, and a separating roller 813. The paper feed unit 810 is mounted on a belt 814 to be movable up and down between the uppermost tray 830 and the lowermost tray 834. A belt 815 is passed over an upper and a lower roller 816 and 817 and positioned to face the paper feed unit 810. When one of the trays 830 to 834 which is loaded with paper sheets of particular size is selected, the paper feed unit 810 is moved upward or downward toward the selected tray. When the paper feed unit 810 is about to reach the particular tray, it is stopped by an output of a sensor, not shown, and the tray is moved toward the unit 810. Then, the paper feed device 800, like the manual paper feed device 701, causes the pull-out roller 811 to draw the paper sheets toward the feed roller 812, and causes the separating roller 813 to separate one paper sheet from the others. This paper sheet is conveyed by the belt 815 to the transport roller 707 of the copier body 200 and therefrom to the register roller pair 706.

Figure 6:
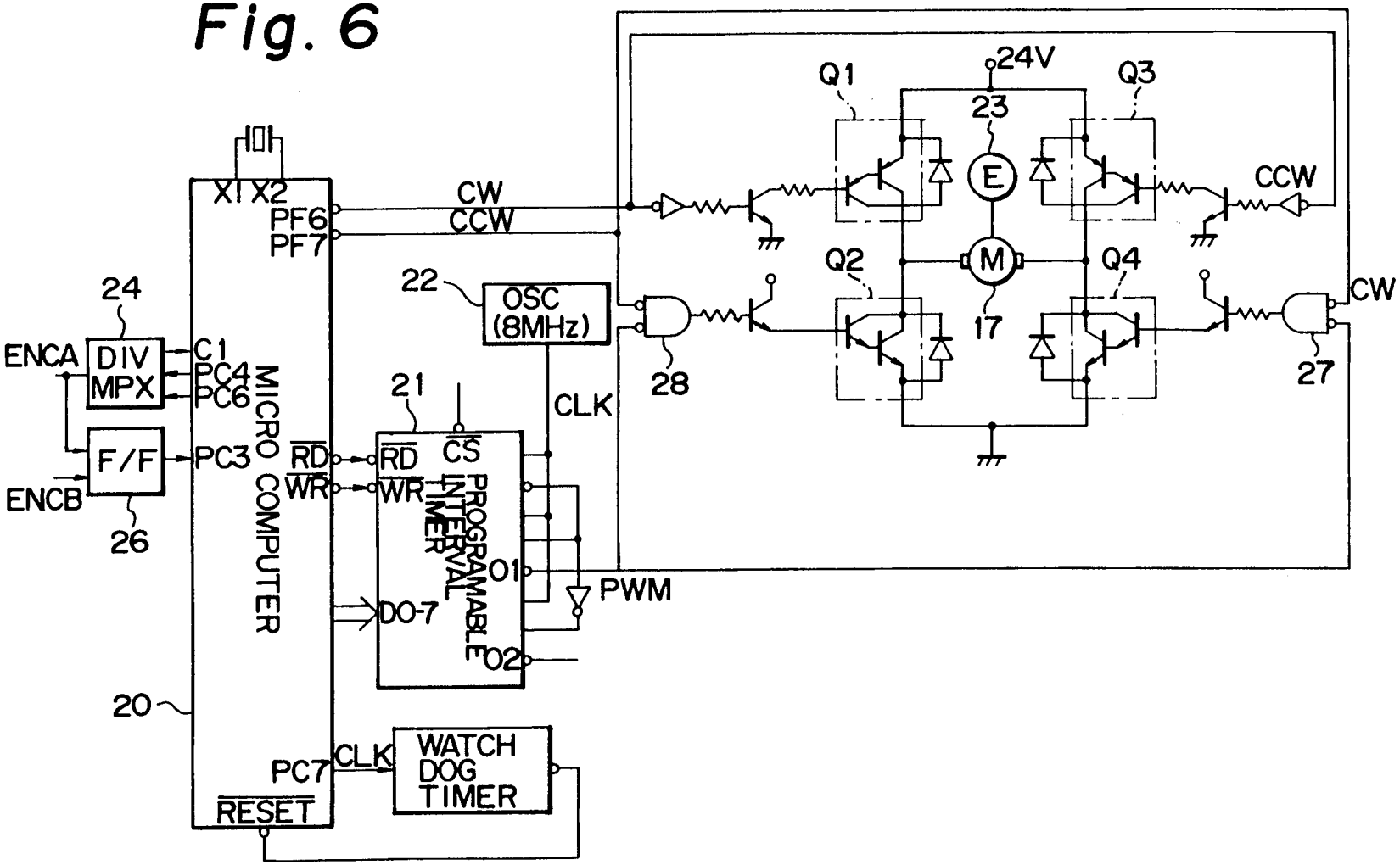
FIG. 6 is a schematic block diagram of a scanning control system associated with optics.

Referring to FIG. 6, control circuitry for controlling the optics 300 will be described. The control circuitry controls the rotation of a DC motor 17. As shown, the circuitry includes a microcomputer 20, a programmable interval timer 21, and transistors Q1, Q2, Q3 and Q4 for driving the DC motor 17. The microcomputer 20 is implemented by 78C10G, for example. Considering the control system of the entire copier, the microcomputer 20 constitutes a scanner controller located on the optics control side, as distinguished from the system control side which covers the entire sequence. The programmable interval timer 21 is connected to the microcomputer 20 and may be implemented by μPD71054G. The timer 21 produces a PWM (Pulse Width Modulation) output for controlling the rotation speed of the DC motor 17 under the control of the microcomputer 20. An 8-megahertz oscillator 22 is connected to the timer 21 to feed a clock signal CLK to the latter.

The DC motor 17 is connected to the microcomputer 20 via the transistors Q1 to Q4. When the transistors Q1 and Q4 are turned on and the transistors Q2 and Q3 are turned off, a current is fed clockwise (CW) to the motor 17. When the transistors Q2 and Q3 are turned on and the transistors Q1 and Q4 are turned off, a current is fed counterclockwise (CCW) to the motor 1. An arrangement is made such that the motor 17 drives the scanners 320 and 330 forward when rotated clockwise and drives them backward when rotated counterclockwise. The rotating direction of the motor 17 is controlled by CW and CCW signals which appear respectively on ports PF6 and PF7 of the microcomputer 20.

A rotary encoder 23 is directly coupled with the DC motor 17 for generating pulses in response to the rotation of the motor 17. The encoder 23 produces two kinds of pulse signals having different phases in association with the amount and direction of rotation of the motor 17, i.e., A-phase encoder pulses ENCA and B-phase encoder pulses ENCB. The A-phase encoder pulses ENCA are applied to a counter input terminal CI of the microcomputer 20 via a frequency dividing multiplexer 24. The microcomputer 20, therefore, counts the intervals of the pulses ENCA by a counter which is built therein and controlled by an oscillation frequency of 10 megahertz of an oscillator 25 of the microcomputer 20. An input signal to the counter input terminal CI is an interrupt input. While an interrupt program is executed, data representative of counted encoder intervals are read and, based on the read data, there are performed the calculation of the rotation speed of the motor 17, the calculation of a motor control amount which uses proportion and integration, the output (loading the timer 21 with data), etc. Specifically, the frequency of the A-phase encoder pulses ENCA is divided by the multiplexer 24 by 1, 2, 4 or 8 in matching relation to a target speed and then applied to the CI terminal. When the frequency is divided by 1, the scanner 320 is moved by 0.116 millimeter in response to one encoder pulse. The microcomputer 20 calculates the velocity of the scanner 320 on the basis of the interrupt intervals. The output timer value is determined by applying proportion and integration processing to the calculated data.

The encoder pulses ENCA and ENCB are fed to an input terminal PC3 of the microcomputer 20 via a flip-flop 26. The microcomputer 20 identifies the rotating direction of the DC motor 17 in response to a phase difference between the encoder pulses ENCA and ENCB. More specifically, the state of the encoder pulses ENCB determined at the leading edges of the A-phase encoder pulses ENCA are fed to the port of the microcomputer 20 and discriminated. The motor 17 has its rotation speed controlled by PWM control. First, at the time of scanning, i.e., when the motor 17 is to be rotated clockwise, the transistor Q1 is turned on while the transistor A4 is turned on and off via a gate circuit 27 by a PWM output of the timer 21. This produces a potential difference across the motor 17 and thereby causes the motor 17 to rotate at a speed associated with the duty ratio of the PWM signal. At the time of returning, the transistor Q3 is rendered conductive while the transistor Q2 is rendered non-conductive via a gate circuit 28 by the PWM output of the timer 21. As a result, a potential difference of the opposite direction is developed across the motor 17 to rotate the motor 17 at a speed associated with the duty ratio of the PWM signal.

The copier system constructed as outlined above will be operated as follows. First, the basic copying operation will be described while omitting the operation of the optics 300 for simplicity.

TWO-SIDED COPY

In a two-sided copy mode, two different transport paths are selectively used with the paper size of A4 (or LT) and smaller sizes and the other paper sizes.

Assume a paper size not greater than A4 (or LT). Then, as shown in FIG. 2, when the trailing edge of a one-sided copy moves away from the heat roller pair 605, the gate 941 is lowered by an output of a sensor 940 while the roller 911 is rotated in the opposite direction to drive the copy toward the transport roller pair 924. The copy coming out of the transport roller pair 924 is moved by the regulating roller 932 toward the paper re-feed device 910. As all the one-sided copies are stacked on the belt 930 of the re-feed device 910, the belt 930 transports only the lowermost copy of the stack to the right as viewed in FIG. 2 by sucking it. When that particular copy reaches the rightmost position in the figure, the separating roller 933 located above the belt 930 and being rotated clockwise separates it from the others. Then, the transport roller pair 707 delivers the copy to the register roller 706.

For a paper size of A4 (or LT) or greater size, a one-sided copy moved away from the heat roller pair 605 is routed through the transport roller pair 911 and the gates 915 and 916 which are positioned as indicated by solid lines in FIG. 2. The copy is further driven by the transport roller pair 912. As soon as the trailing edge of the copy moves away from a sensor 942, the rollers 912, 913, 141 and 142 start rotating in the opposite direction in response to the resulting output of the sensor 942. Simultaneously, the gate 916 is rotated clockwise as viewed in FIG. 2 to a position indicated by a phantom line. As a result, the copy is driven toward the roller pair 917 along the transport path 902, the trailing edge heading at this time. When the paper size is A3 (or 17″), the gate 918 assumes a position indicated by a phantom line so that the copy is directly handed over to the re-feed device 910 after moving away from the roller pair 917. When the paper size is B4 (or 14″), the gate 918 is brought to a position indicated by a solid line while the gate 920 is brought to a position indicated by a phantom line. In this condition, the copy moved away from the roller pair 919 is directly delivered to the re-feed device 910. Further, when the paper size is A4 right or B5 right (or 11″), the gates 918, 920 and 922 are positioned as indicated by a solid line, solid line and phantom line, respectively. This causes the copy to be routed through the roller pair 921 to the re-feed device 910. Thereafter, the copy will be transported in the same manner as has been described in relation to the paper size A4.

MULTIPLE (COMBINATION) COPY

In a multiple copy mode, the gate 915 is brought to a position indicated by a phantom line with no regard to the size of a copy. The copy is, therefore, fed to the roller pair 917 located on the transport path 902. When the paper size is A3 (or 17″), the gate 918 assumes a phantom-line position so that the copy is handed over to the re-feed device 910 immediately after it has moved away from the roller pair 917. When the paper size is B4 (or 14″), the gates 918 and 920 are positioned as indicated by a solid line and a phantom line, respectively, resulting in the copy being routed through the roller pair 919 to the re-feed device 910. When the paper size is A4 right or B5 right (or 11″), the gates 918 and 920 assume the solid line positions while the gate 922 assumes the phantom line position. In this condition, the copy is routed through the roller 921 to the re-feed device 910. Further, when the paper size is not greater than A4 transverse (or LT), the gates 918, 920 and 922 assume their solid-line positions so that the copy is transported to the re-feed device 910 after moving over the gate 922. The regulating roller 932 regulates the stack of copies in the re-feed device 910.

OPERATION OF ARDF

The operation of the ARDF 100 will be described in relation to one-sided documents first. The ARDF 100 feeds a stack of documents in order of page. Specifically, documents are stacked on the tray 103 face up as indicated by an arrow A in FIGS. 2 and 3. The documents, as in the manual sheet feed device 701, are drawn in by the pull out roller 113 to the left as viewed in the figures. The feed roller 115 and separating roller 116 which are rotating clockwise feed out only the uppermost document toward the roller pair 117. The separated document is routed through the roller pair 119 and gates 127 and 129 to between the glass platen 203 and the transport belt 107. On the glass platen 203, the document is brought to a stop at a particular position which is determined by counting pulses from the instant when the trailing edge of the document has moved away from a sensor 145. As soon as the document is scanned, the belt 107 is rotated clockwise as viewed in the figure to drive the document to the left by switching it back. Simultaneously, the gate 127 is rotated upward from the position shown in FIG. 3. Consequently, the document is guided to between the roller 121 and the rollers **119*a* and 117*a* of the roller pairs 119 and 117 which are held in contact with the roller 121. The document is, therefore, routed through the rollers 124 and 125 to the tray 105, as indicated by an arrow B. At this instant, if the documents are immediately discharged onto the tray 105, their order with respect to page will be entirely reversed because they are face up. In the light of this, the ARDF 100 is so constructed as to turn over the documents again. Specifically, as soon as a sensor 147 senses the trailing edge of the document, the rotation of the rollers 121 and 124 is reversed. A signal so reversing the rotation of the rollers 121 and 124 lowers the gate 129 at the same time. Hence, the document is guided onto the tray 105 face down from between the rollers 123 and 124, as indicated by an arrow C. Such a sequence of steps is repeated to stack the successive documents in the same order as the initial order on the tray 101**.

The ARDF 100 is operable with two-sided documents as follows. The ARDF 100 transports a two-sided document to the glass platen 203 and stops its first side thereon by the same procedure as has been described with a one-sided document. As the first side of the document is fully scanned on the glass platen 203, the drive roller 133 is rotated counterclockwise to feed out the document to the left in the figure by switching it back. At this instant, the gate 127 is raised as with a one-sided document, and the gate 131 is also raised. In this condition, the document is transported through the path 132 defined between the roller 121 and the rollers 119*a* and 117*a* and guided by the gate 131 toward the belt 107. As soon as the leading edge of the document reaches the end of the belt 107, the drive roller 133 begins to rotate counterclockwise resulting in the document being turned over and fed onto the glass platen 203. The timing for so switching the rotating direction of the drive roller 133 may be determined by starting counting pulses at the instant when a sensor 147 senses the leading edge of the document. The position on the glass platen 203 where the document is to be stopped is determined by counting pulses which appear after the time when the trailing edge of the document has moved away from the sensor 147, as with a one-sided document. When the second side of the document is fully scanned, the drive roller 133 is rotated clockwise to feed the document to the left by switching it back. In this case, the gate 131 is lowered to guide the document toward the tray 105 by way of the rollers 121 and 119*a* and 117*a* and the rollers 124 and 125, as indicated by an arrow B. After the document has been stacked on the tray 105, the same sequence of steps may be repeated to stack the other documents sequentially on the tray 101 in the original order page.

Now, the operation of the illustrative embodiment associated with the optics and the control over such an operation will be described in detail.

Three different modes are available with the copier, i.e., (A) an automatic paper select mode (APS), (B) paper select mode, and (C) automatic document feeder mode (ADF) mode.

The illustrative embodiment has the APS mode as its standard mode. In this mode, in response to a print key input, the copier senses the size of documents (prescanning), automatically selects matching paper sheets on the basis of the sensed document size and a selected magnification, and then starts on a copying operation. If no matching paper sheets are loaded in the copier, an alert is displayed and the copier is disabled. In the paper select mode, in response to a print key input, documents are reproduced on paper sheets having been selected, with no regard to the document size and in a specified magnification. In the ADF mode, in response to a print key input, a document is automatically fed while its size is sensed, and a matching paper sheet is selected on the basis of the sensed document size and a specified magnification. Again, if no matching paper sheets are present, an alert is displayed and the copier is disabled.

Figure 7:
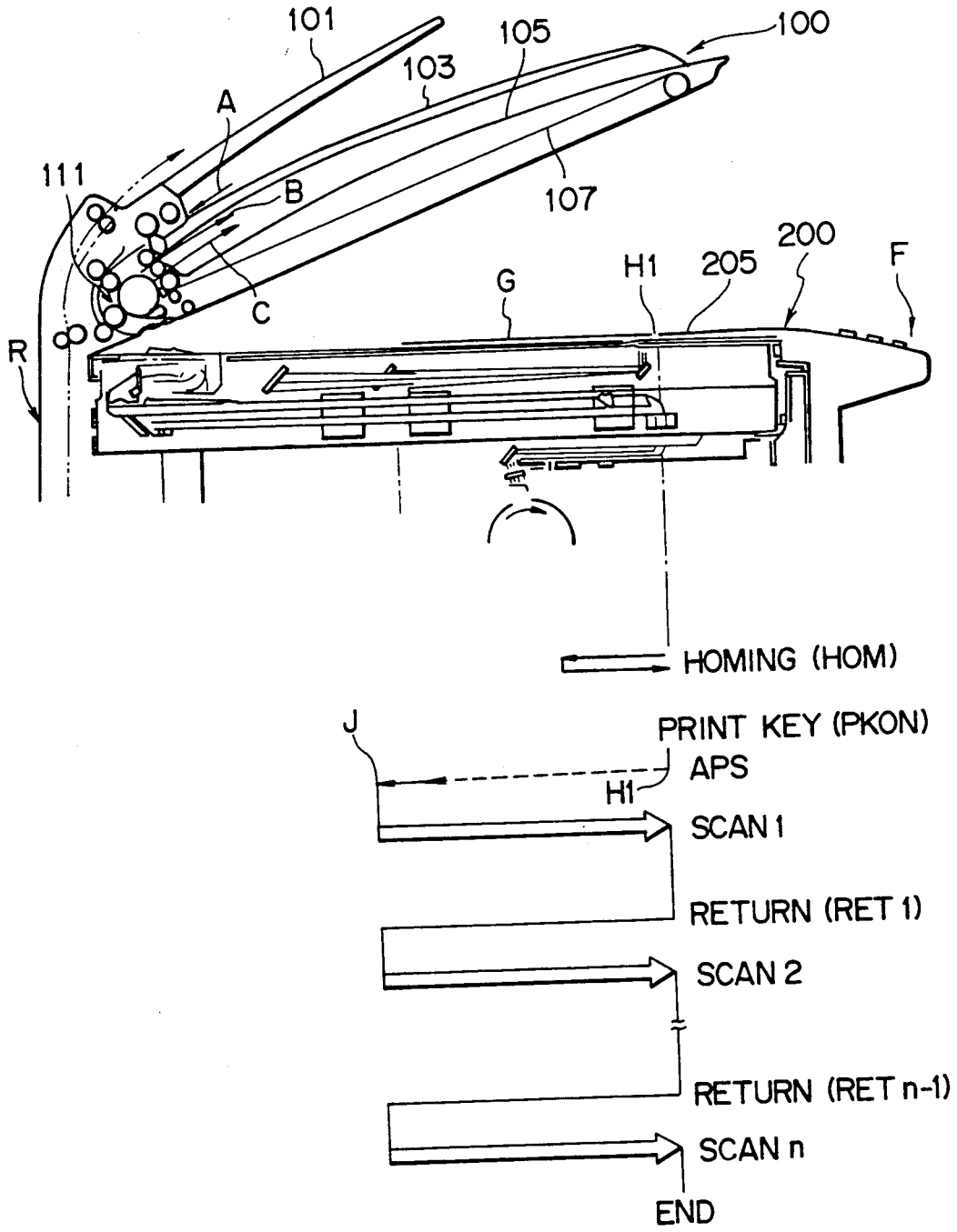
FIG. 7 is a fragmentary view demonstrating an automatic paper select mode operation.

In the illustrative embodiment, the optics 300 has a home position H1, as shown in FIG. 7. In the home position H1, the center of the scanning slit of the first scanner 320 is located at 5 millimeters ahead of a document scale 205, FIG. 7, as viewed from the operating side F. The home position H1 is the initial reference position of the first scanner 320 at the time of turn-on of the power supply. Hence, as indicated by HOM in FIGS. 7, 8 and 9, the homing direction is from the operating side F to the non-operating side R and then from the non-operating side R to the operating side F, i.e., it is opposite to the conventional homing direction. The three different modes (A), (B) and (C) will be described in sequence.

(A) APS MODE

In the APS mode, a document size is sensed by the following procedure. FIG. 7 depicts the movements of the optics 300 which occur in the APS mode with documents of A4 right size by way of example. In response to a print key input (PKON), the scanner 320 carrying the size sensing optical fiber therewith is moved away from the home position H at the linear velocity of 500 millimeters per second while sensing a reflection from a document G (APS). The document G will be sensed as to the widthwise direction as described in detail later. As the length of the document G is sensed, a matching document size is calculated on destination basis. Then, the scanner 320 is brought to a stop at a reference position where the center of the slit will have been moved 30 millimeters further than the calculated length data away from the reference position which is set by the document scale 205 (position J, FIG. 7; 332 millimeters away from the home position H1 in the case of an A4 right document). More specifically, the scanner 320 is stopped after moving an extra 30 millimeters away from the trailing edge of the document G, and this position is used as a scan start position. At this instant, the size sensing section is spaced apart by about 20 millimeters from the center of the slit. With documents of a legal size, therefore, it is possible to stop the scanner 320 within 10 millimeters after it has sensed the trailing edge of the document G. In the case of documents G other than legal size documents, however, the scanner 320 will be stopped at a different position.

The document size sensing section 340 shown in FIGS. 4 and 5 is responsive to the size of documents. When the first scanner 320 moves forward from the operating side F to the non-operating side R as shown in FIG. 5, the lamp 302 is turned on to start sensing the length and width of the document G at a position 20 millimeters away from the document scale 205 (reference document position). A reflection from the document G is incident to the optical fiber 342 and then photoelectrically converted. The resulting analog level is detected by the analog inputs (AN0 to AN2) of the microcomputer which is included in the main controller. The document G, the cover plate 150 and the open state of the cover plate 150 are discriminated, i.e., it is determined that the area is not a document area when the following relations hold:

$$\text{ADS output}/\text{APS output} \geqq 3 \quad (1)$$

$$\text{APS output} \leqq 1(\text{V}) \quad (2)$$

where ADS output is an output of the light-sensitive element associated with the optical fiber 342c which is responsive to document density, i.e., document density output, and APS output is an output of the light-sensitive sensor associated with the optical fiber 342 which is responsive to document length.

Concerning the widthwise direction, whether or not the document G is present is sensed at a position 20 millimeters away from the document scale 205. As regards the lengthwise direction, when the document G is not sensed at a position 20 millimeters away from the scale 205, it is determined that the document G is absent or that the document G cannot be sensed; the scanner 320 is returned to the home position (from the non-operating side R to the operating side F). This also occurs when the scanner 320 has not sensed an area other than the document G even after the travel to the deepest position at the non-operating side R.

Figure 10B:
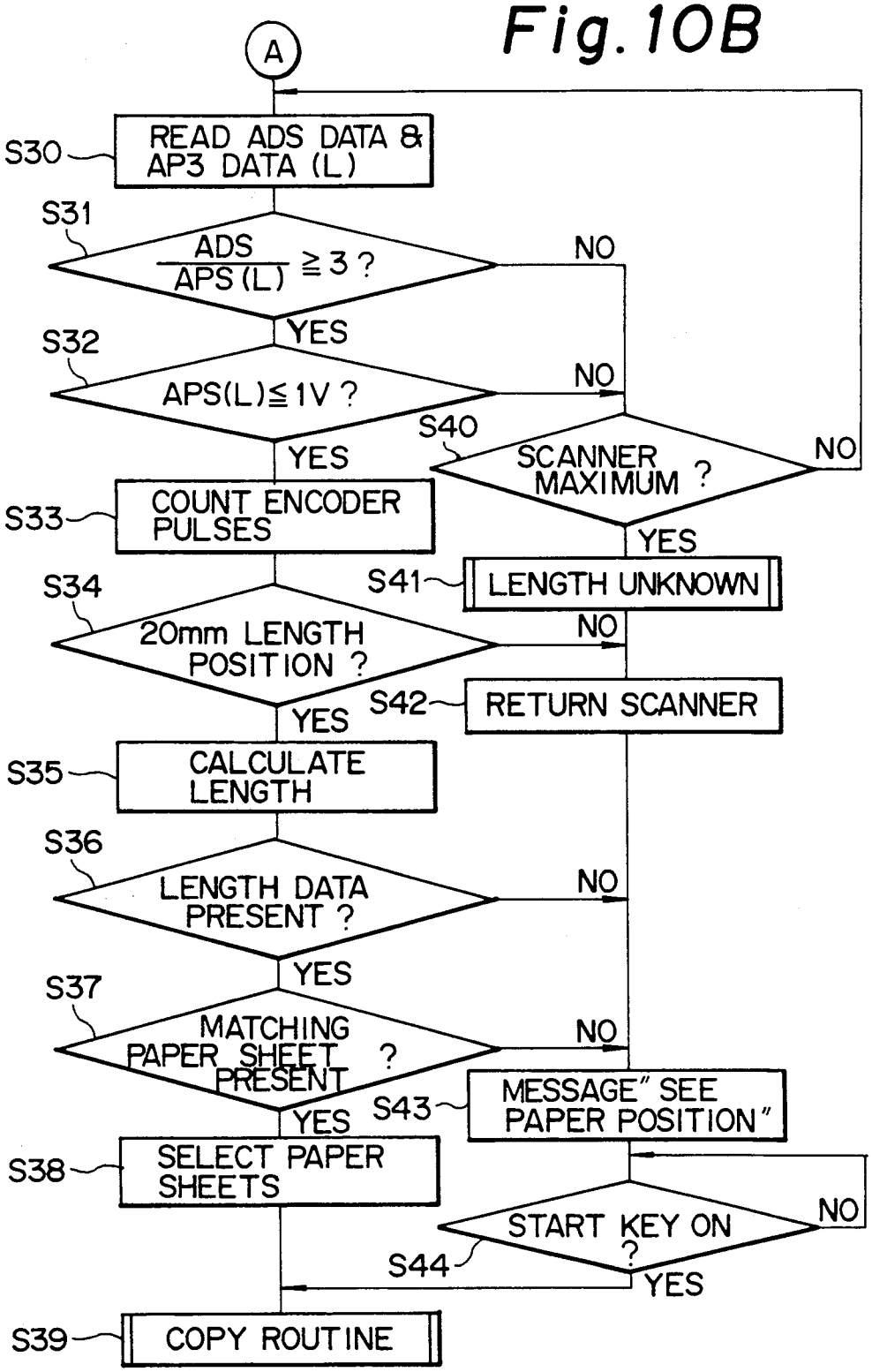
FIGS. 10A and 10B are flowcharts representative of a specific sequence of steps for document size sensing.
Figure 10A:
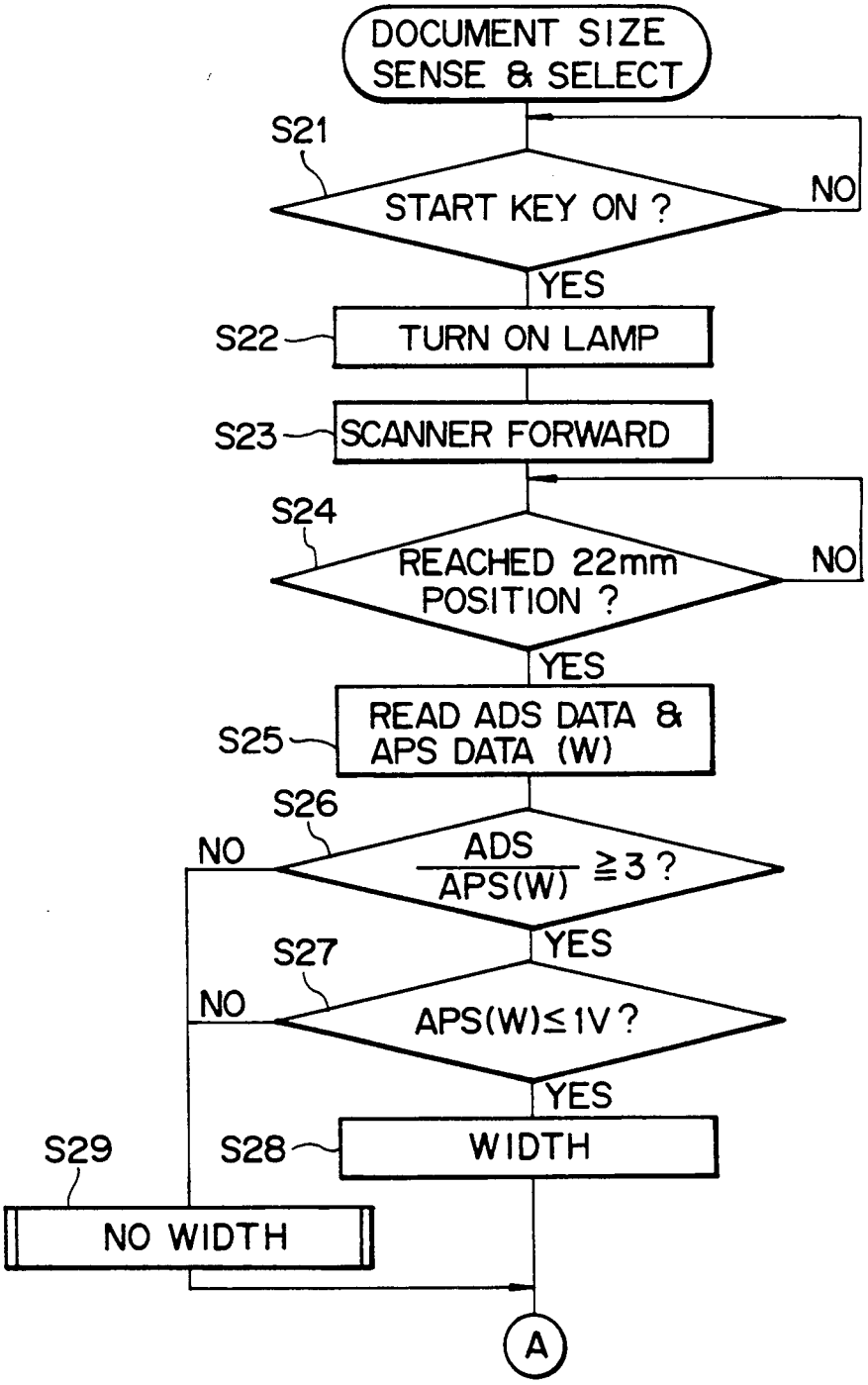

Referring to FIGS. 10A and 10B, the document sensing procedure described above is shown in flowcharts. In a step S21, whether or not the print start switch has been turned on is determined. If the answer of the step S21 is YES, the light source 302 is turned on (step S22) and the scanner is caused into a forward movement (step S23). In a step S24, whether or not the scanner 320 has reached a position 20 millimeters away from the document scale 205 is determined. If the answer of the step S24 is YES, the document density data (ADS) and the document length data (APS) are read (step S25). Then, in a step (S26), whether or not the relation (1) holds with respect to the widthwise direction is determined. If the answer of the step S26 is YES, whether or not the relation (2) holds with respect to the widthwise direction is determined (step S27). If the answer of the step S27 is YES, a subroutine "WIDTH" is executed (step S28). If otherwise, a subroutine "NO WIDTH" is executed (step S29).

In a step S30 which follows the step S28 or S29, the ADS data and APS data are read. In a step S31, whether or not the relation (1) holds is determined. If the answer of the step S31 is YES, a step S32 is executed to see if the relation (2) holds with respect to the lengthwise direction. If the answer of the step S32 is YES, output pulses of the encoder 23 are counted (step S33) and whether or not the scanner 320 is still located 20 millimeters away from the scale 205 is determined (S34). If the scanner 320 is moving forward away from the above-mentioned position, a length is calculated in a step S35. Then, whether or not length data exists is determined in a step S36. If the answer of the step S36 is YES, a step S37 is executed to see if paper sheets matching the length data is present. If the answer of the step S37 is YES, the matching paper sheets are selected out of the multi-stage paper feed device 800 (step S38) and a copy routine is executed (step S39).

If the answer of the step S31 is NO, the program is transferred to a step S40 for determining whether or not the scanner 320 has moved to the maximum position. If the answer of the step S40 is NO, the steps S30, S31 and S32 are repeated. If the answer of the step S40 is YES, a subroutine "LENGTH UNKNOWN" is executed (step S41) and the scanner 320 is returned to the home position H1 (step S42). In a step S43, a message such as "SEE PAPER POSITION" is turned on on the control panel of the copier body 200. In a step S44, whether or not the print start key has been turned on is determined. If the answer of the step S44 is YES, the copy routine is executed (step S39). If the scanner 320 is located 20 millimeters away from the document scale 205 as determined in the step S34, the program is transferred to the step S42. If no length data exists as decided in the step S36 and if no matching paper sheets are present as decided in the step S37, the program is transferred to the steps S43 and S44, respectively.

While the sensing method stated above is the same as with the prior art, the method of decision is opposite to the prior art in that the edge of the cover plate 150 (area other than the document G area) is sensed on the basis of the document G area. It is to be noted that the length of the document G is represented by a position signal on the basis of the coefficient of the encoder 23 which is coupled to the DC motor 17.

The document size data may be transmitted in the form of length data (millimeter) and width/no-width data as has been conventional or in the form of matching document size data.

After the size of the document G has been sensed as described above, the document G is scanned. Specifically, the document G begins to be scanned (SCAN1, FIG. 7) in response to a scanner start signal from the main controller after awaiting an approach section extending within 30 millimeters as measured from the position which is 30 millimeters away from the trailing edge of the document G. The scanner controller (microcomputer 20) transmits the time when the scanner has reached a position (encoder address) aligned with the trailing edge of the document G to the main controller as a leading edge. In response, the main controller uses the leading edge as a reference signal for forming a latent image, as in the prior art. The leading edge is representative of the reference position of the scanner of the optics where the center of the slit will be located at the edge of the document. This is the position where an image begins to be formed on the photoconductive element, and the image forming timings which will be described are controlled by using the leading edge as a reference signal. In response to the leading edge signal, a paper sheet is transported away from the register roller 706 to the coefficient of drum pulses, whereby the leading edge of a latent image formed on the drum 501 and that of the paper sheet are brought into register. While the leading edge has heretofore been the boundary between the document scale 205 and the document G, in the illustrative embodiment the trailing edge of the document G which is remote from the document scale 205 is the reference position.

The scanning speed from the scan start position toward the operating side F is the same as the speed (V) at which a paper sheet is transported in a 1 magnification mode. In an enlarge or reduce mode, the scanning speed is changed to V/m depending on the selected magnification (m: 0.5 to 2). On reading the home position H1, the scanner 320 is stopped and, if the set number of copies is one (one-to-one mode), ends the copying operation. When two or more copies are desired (continuous copy mode), the scanner 320 is returned to the scanner start position at a high speed (RET1, FIG. 7) and then awaits the next scanner start position. Thereafter, the scanner 320 repeats the reciprocating movement until the set number of copies n have been produced (SCAN n, FIG. 7).

Figure 11B:
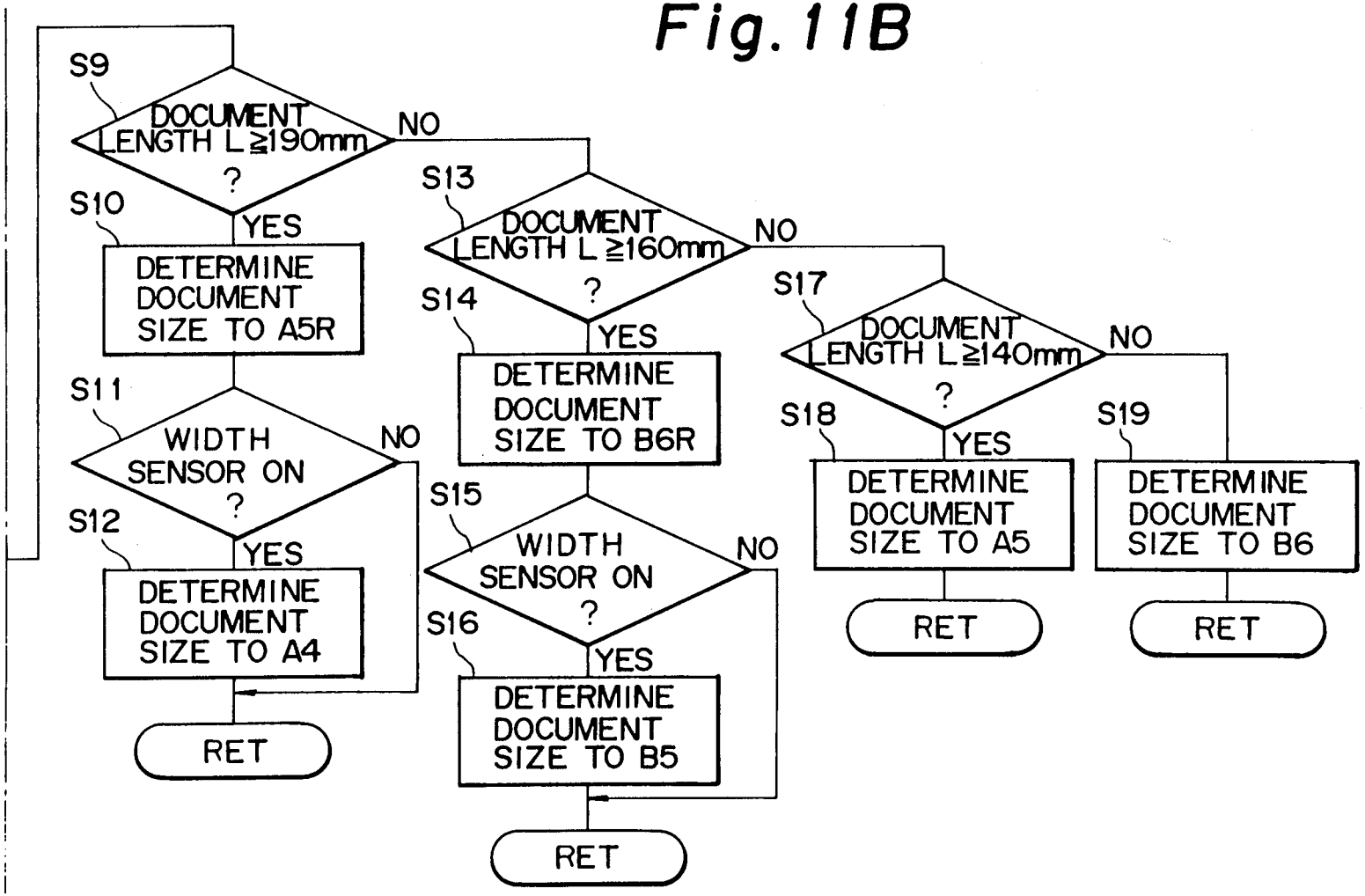
FIGS. 11A and 11B are flowcharts showing a specific document size sensing sequence.
Figure 11A:
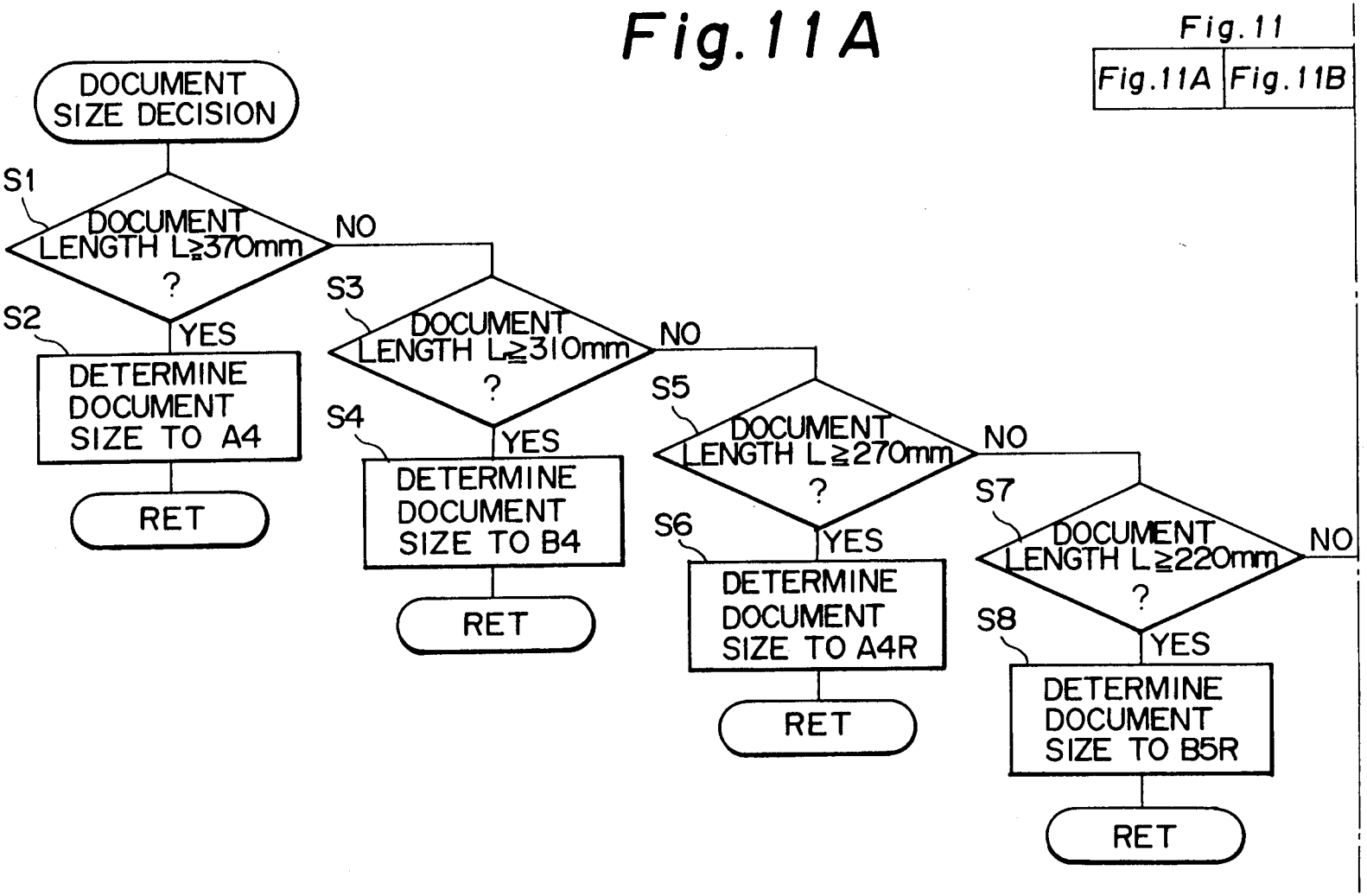

The legal sizes are discriminated by using the sensed data, as shown in FIGS. 11A and 11B. In FIGS. 11A and 11B, when the length L of the document G is greater than 370 millimeters as determined in a step S1, it is determined that the document size is A3 (step S2).

If the length L is less than 370 millimeters, a step S3 is executed to see if it is greater than 310 millimeters. If the answer of the step S3 is YES, the document size is determined to be B4 (step S4); if otherwise, whether or not the length L is greater than 270 millimeters is determined (step S5). If the answer of the step S5 is YES, the document size is determined to be A4 longitudinal (step S6). If the answer of the step S5 is NO, a step S7 is executed to see if the length L is greater than 220 millimeters is determined. If the answer of the step S7 is YES, the document size is determined to be B5 right (step S8). If the answer of the step S7 is NO, whether or not the length L is greater than 190 millimeters is determined (step S9). If the answer of the step S9 is YES, the document size is determined to be A5 right (step S10) and whether or not the width W exists is determined (step S11). If the width sensor is turned off by a reflection being propagated through the photosensot 342*a*, the document size is finally determined to be A5 right. If the width sensor is turned on, the document size is determined to be A4 (step S12). If the answer of the step S9 is NO, a step S13 is executed to see if the length L is greater than 160 millimeters. If the answer of the step S13 is YES, the document size is determined to be B6 right (S14) and, further, whether or not the width sensor is turned on is determined (step S15). If the answer of the step S15 is YES, the document size is determined to be B5 (step S16). If the answer of the step S13 is NO, a step S17 is executed to see if the length L is greater than 140 millimeters. If the answer of the step S17 is YES, the document size is determined to be A5 (step S18); if otherwise, it is determined to be B6 (step S19).

With the procedure described above, it is possible to sense seven different lengths, i.e., 370 millimeters, 310 millimeters, 270 millimeters, 220 millimeters, 190 millimeters, 160 millimeters and 140 millimeters and ten different legal sizes which are represented by the output of the width sensor.

(B) PAPER SELECT MODE

Figure 8:
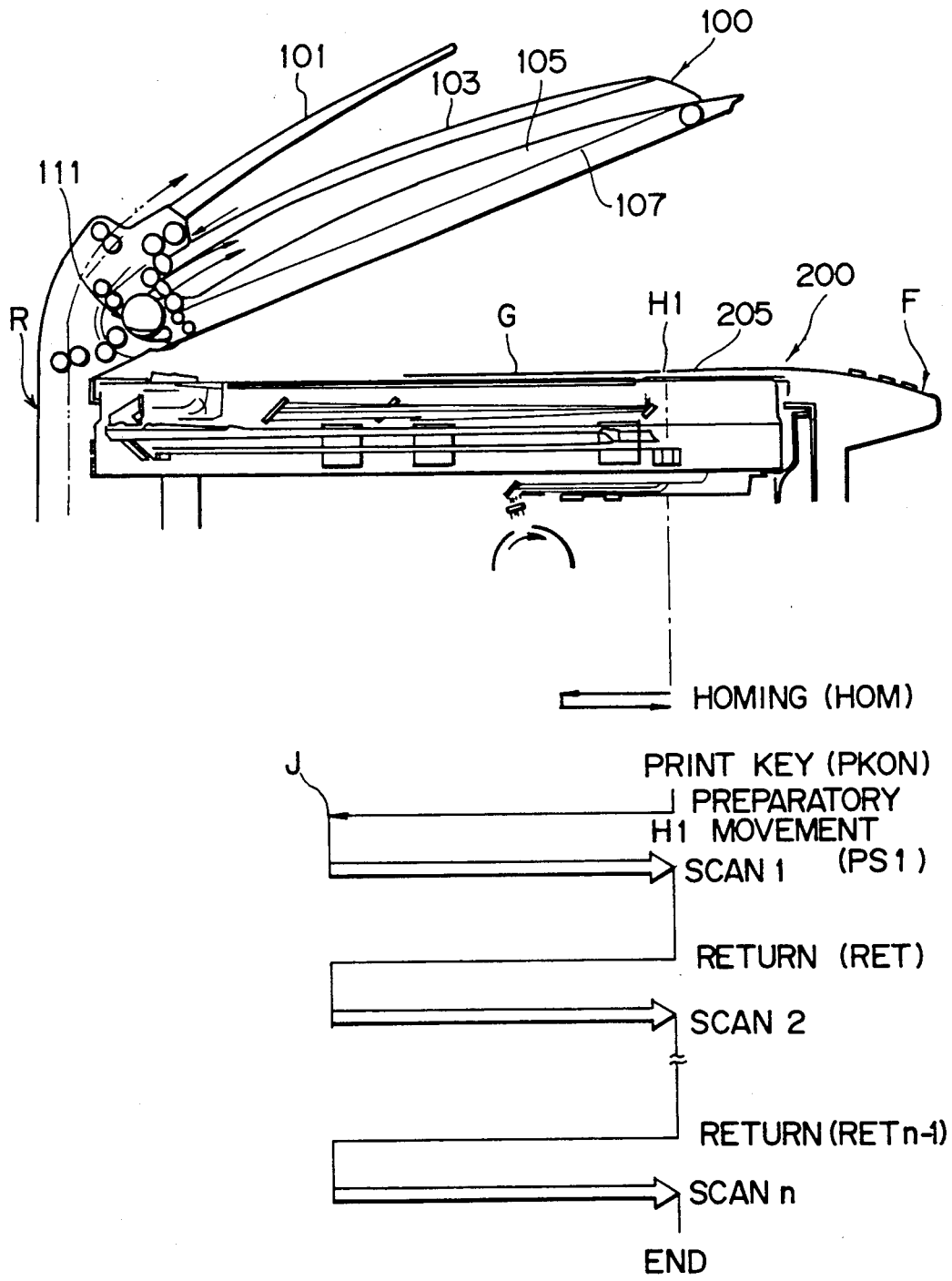
FIG. 8 is a fragmentary view demonstrating a paper select mode operation.
Figure 9:
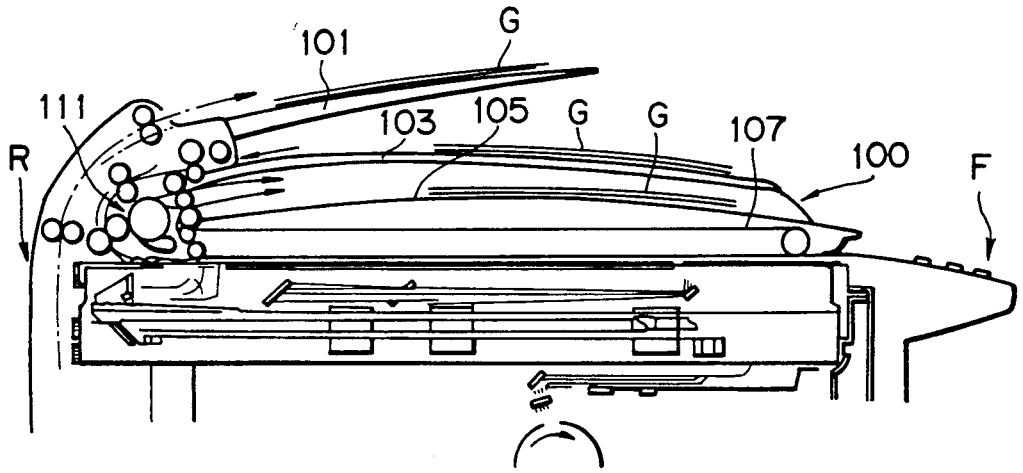
FIG. 9 is a fragmentary view showing an automatic document feeder mode operation.
Figure 9:
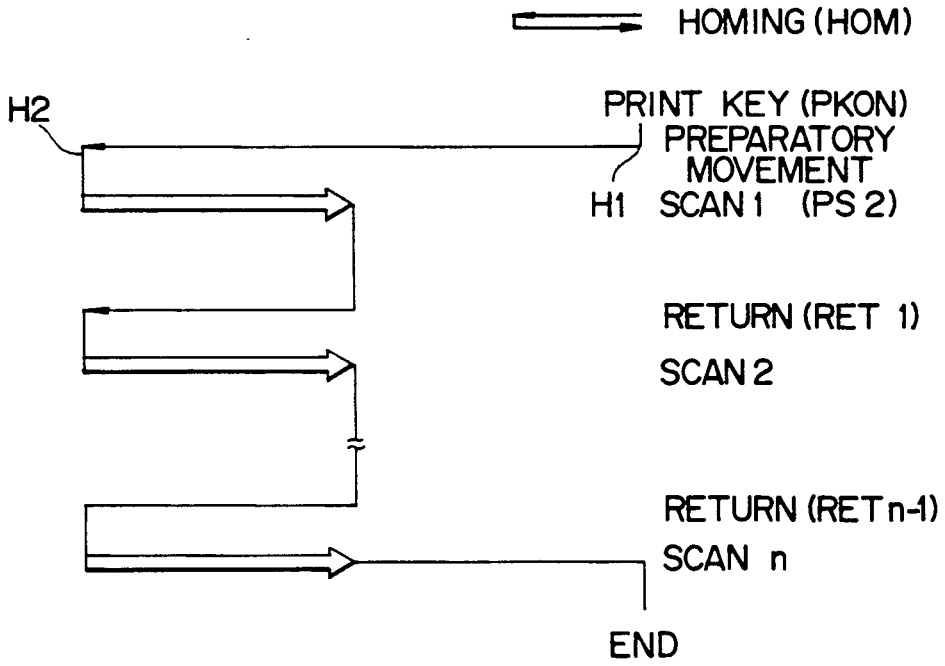

As shown in FIG. 8, in the paper select mode, the scanner 320 is caused into a preparatory movement (PS1). Specifically, the scanner 320 is moved to the scan (approach run) start position J in response to a sheet select key input or a print key input (PKON). The position J is determined by the paper size and the magnification. The position J is defined by adding 30 millimeters to the document size (virtual length) as obtained from the paper size and magnification and is represented by a distance from the reference scale (edge of document scale 205). This distance will be 240 millimeters away from the edge of the scale 205 when the paper size is A4 traverse and the magnification is 1, and it will be 28 millimeters away from the same when the document size is A3 and the magnification is 71%. Such a position is calculated by the same procedure as with the conventional scanner return position.

In the above mode, every time different paper sheets are selected or every time a different magnification is selected, the scan start position of the scanner 320 is changed, as stated previously. Hence, the scanner is moved back and forth in response to every key input. This is analogous to the movement of a lens and mirrors which has customarily been effected every time a magnification has been changed. As the preparatory movement (PS1) is started in response to a print key input (PKON), the operation begins with the conventional scanner return. This is successful in promoting stable control although the fast copy time may have some delay. The preparatory movement (PS1) is followed by document scanning. Again, after n copies have been produced, the scanner 320 awaits at the home position H1.

(C) ADF MODE

In i.e., the automatic document feeder mode the ADF mode, the ARDF 100 effects one-side turn in order to enhance high-speed operations and cost reduction of the copier body 20 and ARDF 100. To this end, in the ADF mode, the reference document position is defined at the rear side R which is opposite to the reference document position for the APS mode and paper select mode. Stated another way, the reference position in the ADF mode is relatively the same as the reference position of the prior art copier, the rotating direction of the drum 501, and the scanning direction of the scanner 320. In this particular mode, best seen in FIG. 9, when the document G is laid on the ARDF 100 and the print key is pressed (PKON), the scanner 320 moves from the home position H1 to an ADF home position H2 474 millimeters away from the home position H1 at a high speed. Since the glass platen 203 is set by assuming the A3 right position to be the maximum size, the scanner 320 awaits an approach run of 30 millimeters at a position 444 millimeters away from the home position H1. The scanner 320 scans a document in the conventional manner. Specifically, on receiving a scanner start signal from the main controller, the scanner 320 starts scanning a document and, at an encoder address associated with 444 millimeters, transmits a leading edge signal. This signal is used as a reference signal for the subsequent image forming sequence. On receiving a scanner return signal as produced by the main controller from the document size, the scanner returns to the above-mentioned 474 millimeters position at a high speed (RET1). A home position sensor heretofore associated with the copier body 200 is replaced with an encoder address which is associated with 474 millimeters. If desired, however, another position sensor may be located at the 474 millimeters position to cope with positional errors which may occur due to repetitive operations. When the last document set on the RDF 100 is fully scanned, the scanner returning operation is not effected, i.e., the scanner 320 is returned to the home position H1 and stopped there.

The preparatory movement (PS2) occurs while the first document is fed and, therefore, does not delay the copy time at all. Further, the movement of the scanner 320 to the home position H1 after scanning also occurs when a copying cycle is under way and, therefore, it does not effect the copying rate of the copier 200.

As described above, the illustrative embodiment saves space by locating the copy outlet 102 in an upper part of the ARDF 100, i.e., causing a paper sheet to be fed from the front to the rear along a horizontal path and discharging the resulting copy onto the upper tray 101 of the ARDF 100.

As shown in FIG. 2, the drum 510 forms a latent image while rotating clockwise as viewed from the left of the copier body 200. The operator, therefore, loads documents by using the document scale 205 which is adjacent to the front end F, as with the prior art copier. Then, scanning begins at the edge of the document which has heretofore been the trailing edge and ends at the reference document position. Such a location of the reference document position promotes easy and accurate positioning of documents, especially small size documents and books.

While the document is scanned to the rear edge, a reflection is sensed by the optical fiber 342 to determine the size of the document. This makes it needless to cause the scanner to perform one full reciprocation, thereby increasing the efficiency and the productivity associated with the APS mode.

In summary, the present invention provides a copier which has a reference document position defined at the operating side thereof which is close to the operator, thereby promoting efficient document handling and easy copying work. Further, the copier senses a document size during the course of a forward movement to free optics thereof from wasteful scanning and, therefore, promotes further efficient copying operations.

Various modifications will become possible for those skilled in the art after receiving the teachings of the present disclosure without departing from the scope thereof.

What is claimed is:

1. A copier for electrostatically forming on a photoconductive element a latent image representative of an image of a document which is laid on a glass platen by illuminating said document through a slit, developing said latent image and transferring said developed image to a paper sheet, said copier comprising:

a copier body having an operating side at which operator controls for operating the copier are positioned and a non-operating side at a rear side of the copier body substantially opposite the operating side, respectively;

optics for imagewise exposure movable back and forth between the operating side and the non-operating side for illuminating the document;

first reference document position setting means for setting a reference position at the glass platen where the document is to be laid, the reference position being positioned at the operating side of the copier body;

control means for determining a scan start position of the optics, the scan start position being defined at the non-operating side of the copier body.

2. A copier according to claim 1, further comprising document size sensing means for sensing a size of the document.

3. A copier according to claim 2, wherein said document size sensing means senses the size of the document while the optics move from the reference position to the scan start position.

4. A copier according to claim 2, further comprising magnification setting means for setting a magnification.

5. A copier according to claim 4, wherein the control means further includes means for determining an approach run start position and the scan start position of the optics in response to the size of the document sensed by the document size sensing means and the magnification set by the magnification setting means.

6. A copier according to claim 5, further comprising paper size sensing means for sensing a size of paper sheets to be selected for transfer of the developed image thereto.

7. A copier according to claim 6, wherein the control means further includes means for determining the approach run start position and the scan start position of said optics in response to the magnification set by the magnification setting means and the paper size sensed by the paper size sensing means.

8. A copier according to claim 1, further comprising automatic document feeding means for automatically feeding the document to the glass platen.

9. A copier according to claim 8, further comprising second reference document position setting means for setting the reference document position at the non-operating side of the copier body.

10. A copier according to claim 9, wherein the control means further includes means for controlling the first and second document reference setting means so that the second reference document position setting means is enabled for a mode using the automatic document feeding means and the first reference document setting means is enabled for a mode which does not use the automatic document feeding means.

11. A copier according to claim 10, wherein the optics illuminate the document while moving from the non-operating side toward the operating side.

* * * * *